US011187066B2

(12) United States Patent
Aljindan et al.

(10) Patent No.: US 11,187,066 B2
(45) Date of Patent: Nov. 30, 2021

(54) LIFTING CONDENSATE FROM WELLBORES

(71) Applicant: Saudi Arabian Oil Company, Dhahran (SA)

(72) Inventors: Jana Mohammed Aljindan, Dhahran (SA); Mohamed Nabil Noui-Mehidi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 8 days.

(21) Appl. No.: 16/584,174

(22) Filed: Sep. 26, 2019

(65) Prior Publication Data

US 2021/0095544 A1 Apr. 1, 2021

(51) Int. Cl.

| | |
|---|---|
| ***E21B 43/18*** | (2006.01) |
| ***E21B 37/00*** | (2006.01) |
| ***E21B 47/06*** | (2012.01) |
| ***E21B 43/25*** | (2006.01) |
| *E21B 36/04* | (2006.01) |

(52) U.S. Cl.

CPC ..... *E21B 43/18* (2013.01); *E21B 37/00* (2013.01); *E21B 43/25* (2013.01); *E21B 47/06* (2013.01); *E21B 36/04* (2013.01)

(58) Field of Classification Search

CPC ..... E21B 37/00; E21B 47/06; E21B 36/04; E21B 41/00; E21B 43/00; E21B 43/12; E21B 43/295; E21B 43/18; E21B 43/25

See application file for complete search history.

(56) References Cited

U.S. PATENT DOCUMENTS

| | | | | |
|---|---|---|---|---|
| 4,369,839 | A * | 1/1983 | Freeman | E21B 43/00 166/369 |
| 4,370,886 | A | 2/1983 | Smith, Jr. et al. | |
| 7,810,563 | B2 | 10/2010 | Buijse et al. | |
| 9,844,166 | B2 | 12/2017 | Shelutt et al. | |
| 2004/0129428 | A1 | 7/2004 | Kelley | |
| 2016/0326839 | A1 | 11/2016 | Ayub et al. | |
| 2019/0353632 | A1* | 11/2019 | Pelletier | E21B 49/10 |

FOREIGN PATENT DOCUMENTS

WO WO 2015152907 10/2015

OTHER PUBLICATIONS

Chew, "Mechanical vacuum pumps," BOC Edwards, Crawley, United Kingdom, 2007, 22 pages.

PCT International Search Report and Written Opinion in International Appln. No. PCT/US2020/052216, dated Jan. 18, 2021, 15 pages.

* cited by examiner

*Primary Examiner* — Brad Harcourt

(74) *Attorney, Agent, or Firm* — Fish & Richardson P.C.

(57) ABSTRACT

A vacuum chamber is evacuated by a vacuum pump. The vacuum chamber is positioned within a wellbore. A wellbore is fluidically exposed to an interior of the vacuum chamber after the vacuum chamber has been evacuated. At least a portion of condensate within the wellbore is flashed responsive to fluidically exposing a wellbore to an interior of the vacuum chamber.

19 Claims, 5 Drawing Sheets

LIFTING CONDENSATE FROM WELLBORES

TECHNICAL FIELD

This disclosure relates to hydrocarbon production.

BACKGROUND

Most wells behave characteristically different over time due to geophysical, physical, and chemical changes in the subterranean reservoir that feeds the well. For example, the phase composition of a production fluid can change during the production life cycle, meaning liquid production can increase or decrease relative to gas production. Such liquids can include water or condensate. As production parameters of the well change, additional equipment can be added to maintain production. For example, a downhole pump or compressor is sometimes used to extend the life of the well.

SUMMARY

This specification describes technologies relating to lifting condensate from wellbores.

An example implementation of the subject matter described within this disclosure is a method with the following features. A vacuum chamber is evacuated by a vacuum pump. The vacuum chamber is positioned within a wellbore. A wellbore is fluidically exposed to an interior of the vacuum chamber after the vacuum chamber has been evacuated. At least a portion of condensate within the wellbore is flashed responsive to fluidically exposing a wellbore to an interior of the vacuum chamber.

Aspects of the example implementation, which can be combined with the example implementation alone or in combination, include the following. The vacuum chamber is received into the wellbore.

Aspects of the example implementation, which can be combined with the example implementation alone or in combination, include the following. Receiving the vacuum chamber into the wellbore includes receiving the vacuum chamber such that the vacuum chamber is at a depth roughly adjacent to a pay zone of a wellbore.

Aspects of the example implementation, which can be combined with the example implementation alone or in combination, include the following. Exposing the wellbore to the interior of the vacuum chamber includes reducing a pressure within the wellbore by 2500 pounds per square inch.

Aspects of the example implementation, which can be combined with the example implementation alone or in combination, include the following. Substantially free gas is flowed out of the wellbore.

Aspects of the example implementation, which can be combined with the example implementation alone or in combination, include the following. The vacuum chamber is removed from the wellbore after flashing the condensate.

Aspects of the example implementation, which can be combined with the example implementation alone or in combination, include the following. Fluidically exposing the wellbore to an interior of the vacuum chamber includes uncovering openings defined by an outer wall of the vacuum chamber.

Aspects of the example implementation, which can be combined with the example implementation alone or in combination, include the following. Microwaves are emitted within the wellbore by a microwave emitter positioned within the wellbore. At least a portion of condensate within the wellbore is flashed responsive to emitting the microwaves.

An example implementation of the subject matter described within this disclosure is a well intervention tool with the following features. A vacuum chamber is fluidically connected to a vacuum pump. The vacuum chamber includes an outer surface defining a chamber fluidically coupled to the vacuum pump. The outer surface defines an actuable orifice that is actuable between and open state and a closed state. The orifice fluidically connects the chamber and a downhole environment in the open state. The orifice fluidically isolates the chamber from the downhole environment in a closed state.

Aspects of the example implementation, which can be combined with the example implementation alone or in combination, include the following. The vacuum pump is located within the downhole environment.

Aspects of the example implementation, which can be combined with the example implementation alone or in combination, include the following. The actuable orifice includes a sleeve defining a profile that mates with the outer surface of the vacuum chamber. The sleeve is rotatable in a circumferential direction along the surface of the vacuum chamber.

Aspects of the example implementation, which can be combined with the example implementation alone or in combination, include the following. A motor is coupled to the sleeve. The motor is arranged to change the sleeve between the open state and the closed state.

Aspects of the example implementation, which can be combined with the example implementation alone or in combination, include the following. The vacuum pump includes a positive displacement pump.

Aspects of the example implementation, which can be combined with the example implementation alone or in combination, include the following. The orifice is a first orifice. The well intervention tool includes a multiple orifices. The orifices have a total flow area sufficient to allow fluid communication. Each of the orifices has a flow area small enough to filter sand out of a fluid flow.

An example implementation of the subject matter described within this disclosure is a well system with the following features. A vacuum chamber is fluidically connected to a vacuum pump. The vacuum chamber includes an outer surface defining a chamber fluidically coupled to the vacuum pump. The outer surface defines an actuable orifice that is actuable between and open state and a closed state. The orifice fluidically connects the chamber and a downhole environment in the open state. The orifice fluidically isolates the chamber from the downhole environment in a closed state. A length of coiled tubing fluidically connects the vacuum chamber to a topside facility.

Aspects of the example implementation, which can be combined with the example implementation alone or in combination, include the following. The vacuum pump is located at the topside facility. The vacuum pump is fluidically connected to the vacuum chamber by the length of coiled tubing.

Aspects of the example implementation, which can be combined with the example implementation alone or in combination, include the following. A controller is configured to receive a signal indicative of a wellbore pressure. The controller is configured to determine, based on the signal, a presence of a condensate bank. The controller is configured to evacuate a vacuum chamber, by a vacuum pump, in response to determining the presence of a condensate bank. The controller is configured to fluidically expose the evacuated vacuum chamber to a wellbore environment.

Aspects of the example implementation, which can be combined with the example implementation alone or in combination, include the following. The actuable orifice includes a sleeve defining a profile that mates with the outer surface of the vacuum chamber. The sleeve is rotatable in a circumferential direction along the surface of the vacuum chamber.

Aspects of the example implementation, which can be combined with the example implementation alone or in combination, include the following. A motor is coupled to the sleeve. The motor is arranged to change the sleeve between the open state and the closed state.

Aspects of the example implementation, which can be combined with the example implementation alone or in combination, include the following. The vacuum chamber and length of coiled tubing are permanently installed within the downhole environment.

Aspects of the example implementation, which can be combined with the example implementation alone or in combination, include the following. Sand separation facilities are at the topside facility.

Particular implementations of the subject matter described in this specification can be implemented so as to realize one or more of the following advantages. The systems and methods described herein can be implemented on short notice without mobilizing a drill rig. The systems and methods described herein can increase the productive lifespan of a production well with minimal downtime. The system described herein can be permanently or temporarily installed within a production wellbore.

The details of one or more implementations of the subject matter described in this specification are set forth in the accompanying drawings and description. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

In hydrocarbon production, condensate caps can occur, particularly in retrograde condensate production wells. The formation of such caps can reduce or cease gas production within a wellbore. When this happens, submersible pumps are sometimes deployed to produce the condensate liquid. Such interventions require extensive downtime and large pieces of equipment to be installed during a workover. In some instances, production wells can be abandoned entirely in response to the formation of such caps. In some instances, injecting dry gas into the reservoir can help maintain the reservoir pressure above the dew point pressure as well as displace the valuable condensate in the reservoir and re-vaporizes the condensate if a blockage is performed. Adding gas injection facilities require extensive downtime and large facilities to be installed. In some instances, capillary pressure, which causes condensate to be trapped in the reservoir, can be reduced by decreasing the interfacial tension. Solvents like alcohol can be used to reduce the interfacial tension or wettability and remove condensate through a multi-contact miscible displacement. Large quantities of such solvents are required for such a solution and require the construction of chemical injection facilities.

This disclosure describes removing a condensate blockage or cap using a vacuum source within the wellbore. A blockage is detected based on a wellbore pressure. When a blockage occurs, the vacuum source is activated to decrease the pressure within the wellbore. The decreased pressure changes the condensate from a mixed-phase gas condensate to a gas phase. This will free the near wellbore region from an excess of condensate and allow gas from the reservoir to more freely flow into the wellbore. The gas phase is then produced.

Figure 1A:
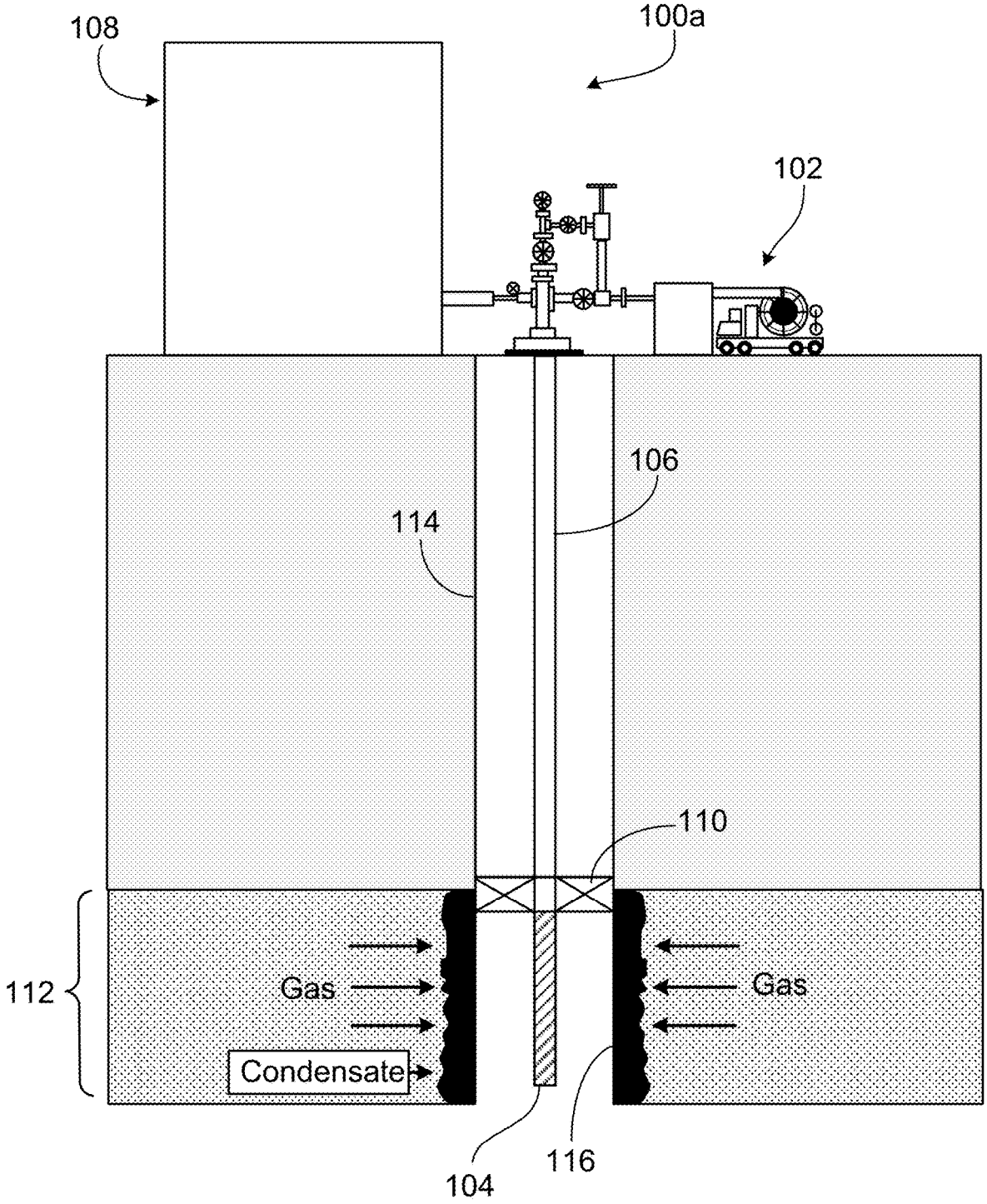
FIG. 1A is a side cross-sectional view of an example well system.

FIG. 1A illustrates a side cross-sectional diagram of an example well system 100*a*. The well system 100*a* includes a vacuum pump 102. A vacuum chamber 104 is fluidically connected to the vacuum pump 102. The vacuum chamber 104 is positioned within the wellbore 114 such that it is substantially laterally adjacent to the production zone 112, and can extend substantially one-half to an entire length of the production zone 112. For example, for a production zone extending fifty feet, the vacuum chamber 104 length would be between twenty-five feet and fifty feet within standard manufacturing tolerances. As illustrated, a condensate cap 116 is present and can inhibit production.

A tubular 106 fluidically connects the vacuum chamber 104 to a topside facility 108. Such a tubular 106 can include coiled tubing, production tubing, drill pipe, or any other tubular that is rated for vacuum within a wellbore environment. In some implementations, sand separation facilities can be included at the topside facility 108. An isolation packer 110 fluidically isolates a production zone 112 from a remainder of a wellbore 114.

In some implementations, the vacuum pump 102 can be a positive displacement pump such as a diaphragm or plunger pump. In some implementations, other pump styles can be used as vacuum pumps, such as a centrifugal pump. In some implementations, multiple pumps can be used to achieve the desired vacuum. While illustrated as a vertical wellbore for simplicity, the concepts described herein are applicable to horizontal and deviated wellbores as well.

Figure 1B:
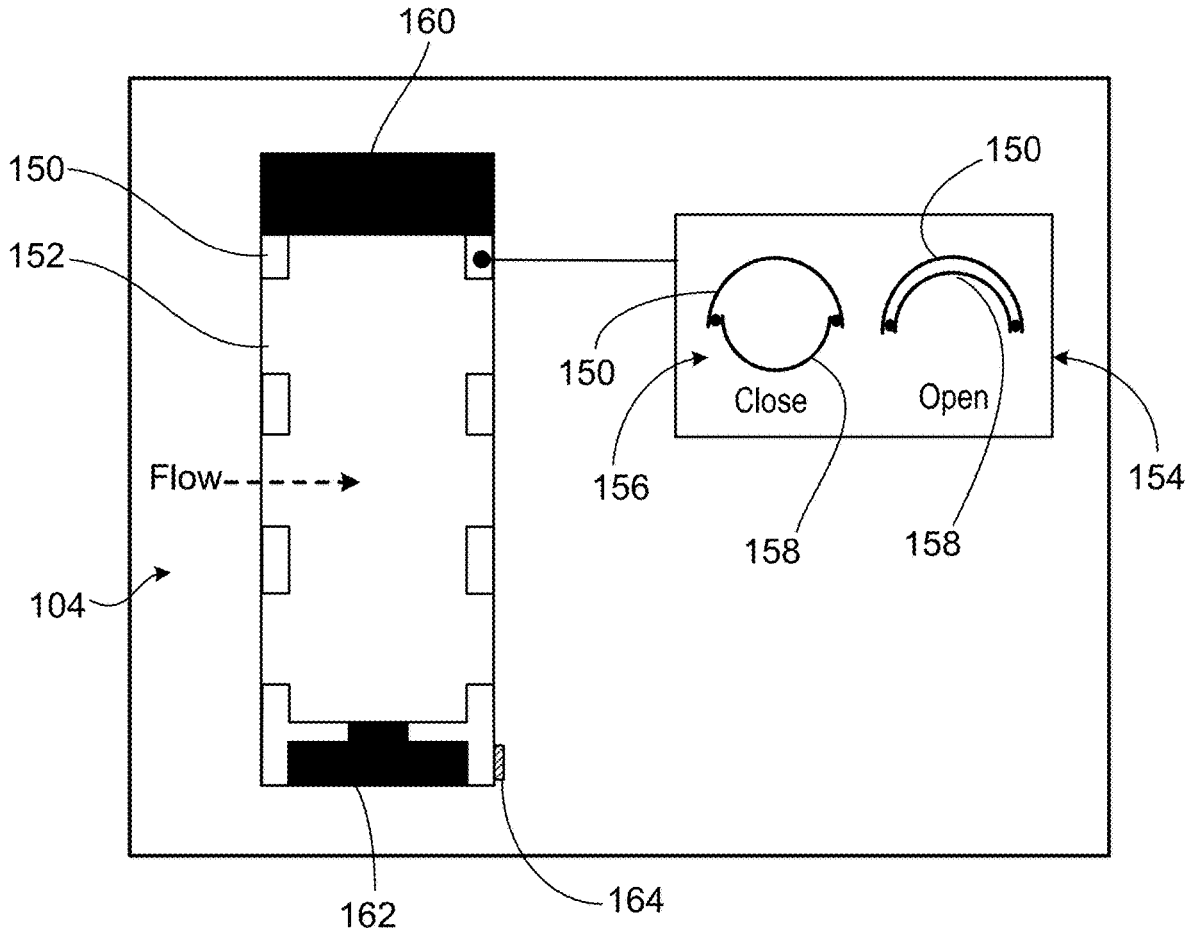
FIG. 1B is a side cross-sectional view of an example vacuum chamber.

FIG. 1B is a side cross-sectional view of an example vacuum chamber 104. The vacuum chamber 104 includes an outer surface 150 defining the vacuum chamber 104. The outer surface 150 defines an actuable orifice 152 that is actuable between an open state 154 and a closed state 156. The orifice 152 fluidically connects the vacuum chamber 104 and a downhole environment, such as the wellbore 114, when in the open state 154. The orifice 152 fluidically isolates the vacuum chamber 104 from the downhole environment, such as the wellbore 114, when in a closed state 156. In some implementations, the actuable orifice 152 of the vacuum chamber 104 includes a sleeve 158 defining a profile that mates with the surface 150 of the vacuum chamber 104. The sleeve 158 is rotatable in a circumferential direction along the surface of the vacuum chamber 104. The sleeve 158 can be arranged such that it rotates along either an inner surface or an outer surface of the vacuum chamber 104. In some implementations, multiple sleeves can be used. A motor or actuator 160 is coupled to the sleeve 158. The actuator 160 is arranged to change the sleeve 158 between the open state 154 and the closed state 156. For example, the actuator 160 can rotate the sleeve to remove a restriction from the orifice 152 and allow fluid contact between the vacuum chamber 104 and the wellbore 114. Such an arrangement allows for a near-instant pressure drop (within a few seconds), allowing the condensate to at least partially flash from a liquid state to a gaseous stated. The pressure drop is not at the reservoir level at this stage, rather it provides a suction effect which flashes condensate from the production zone 112. The amount of condensate removal depends of the total volume of the vacuum chamber. In some instances, the system can be cycled multiple times to achieve a target pressure drop. While illustrated as being cylindrical in shape, the vacuum chamber 104 can be constructed in a variety of shapes without departing from this disclosure so long as the interior volume is sufficient to create the desired pressure drop within the wellbore 114 during operation. Similarly, other actuation mechanisms and arrangements can be used without departing from this disclosure.

In some implementations, a microwave emitter 162 can be attached to the vacuum chamber 104. The microwave emitter 162 can be used to add heat to a production fluid and at least partially change a portion of the liquid phase into a gas phase. In some implementations, the microwave emitter 162 can be sized to achieve the desired heating affects. For example, a 1000-Watt microwave emitter can be used.

A pressure sensor 164 is attached to or in proximity to the vacuum chamber 104. The pressure sensor 164 creates a digital or analog pressure stream that can be interpreted by a controller. Such a controller is described later within this disclosure.

In some implementations, the orifice 152 is a first orifice 152. The well vacuum chamber 104 can include multiple orifices 152. In general, the orifices 152 have a total flow area sufficient to allow fluid communication with the wellbore 114, while each of the individual orifices 152 can have a flow area small enough to filter sand out of a fluid flow. In some implementations, separate sand screens in the wellbore or separate sand screens encircling the vacuum chamber 104 can be used. The well system 100 described herein can be installed temporarily to relieve a condensate cap 116, or it can be permanently installed, such as when a condensate cap 116 is expected to be a regular occurrence during the production life of the wellbore 114.

Figure 1C:
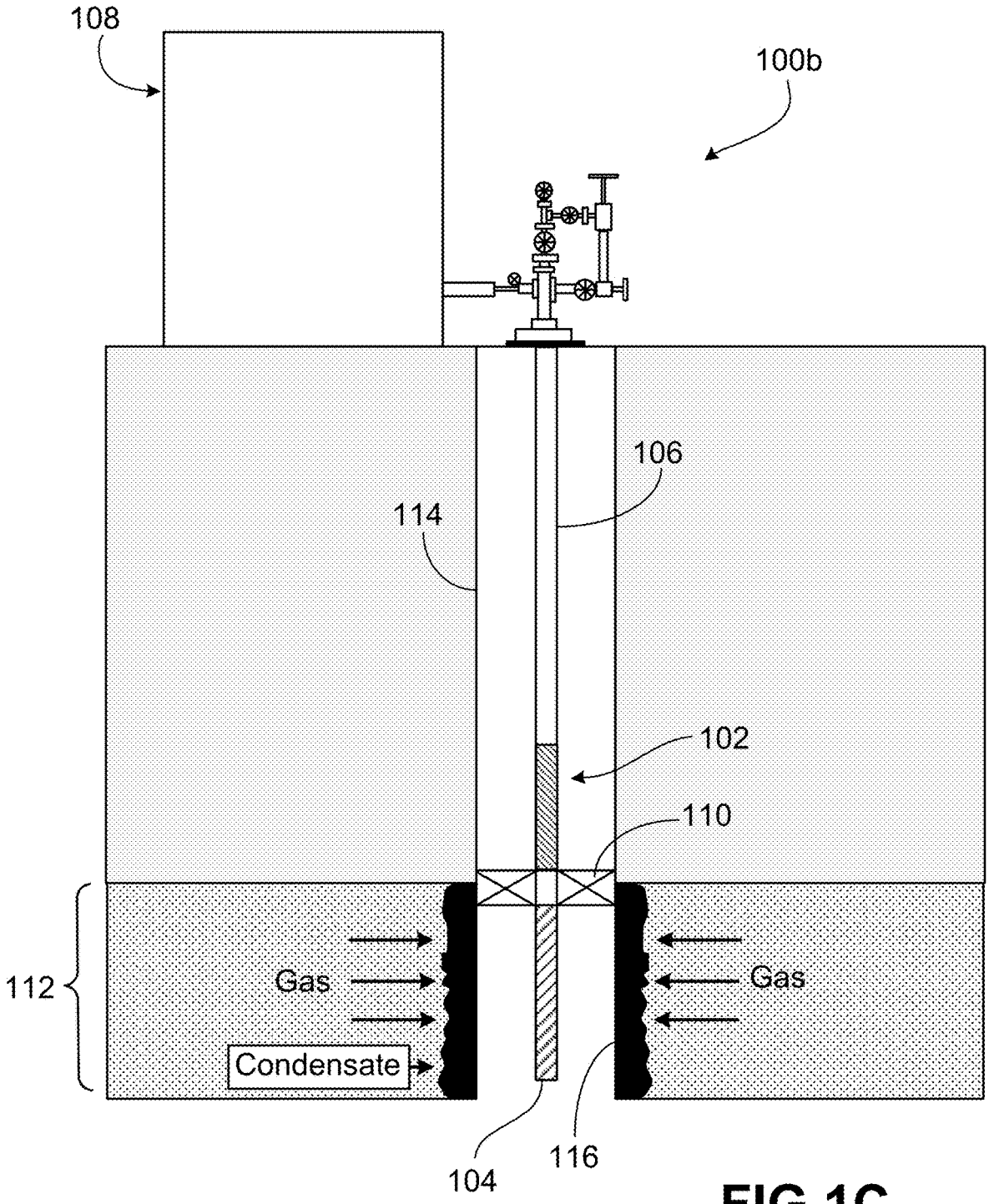
FIG. 1C is a side cross-sectional view of an example well system.

In some implementations, such as the one illustrated in FIG. 1A, the vacuum pump 102 is located at the topside facility 108. In such an implementation, the vacuum pump 102 is fluidically connected to the vacuum chamber 104 by the tubular 106. The well system 100*b* illustrated in FIG. 1C is substantially similar to the implementation illustrated in FIG. 1A with the exception of any differences described herein. In some implementations, such as the one illustrated in FIG. 1C, the vacuum pump 102 is located within the wellbore 114. While illustrated as being installed uphole of the packer 110, the vacuum pump 102 can be located downhole of the packer 110 as well. In implementations where the vacuum pump 102 is located within the wellbore, power can be provided from the topside facility to power the vacuum pump 102. Regardless of the vacuum pump 102 location, the vacuum chamber 104 is fluidically connected to the topside facility 108 by the tubular 106 so that wellbore fluids can be lifted from the wellbore 114 through the tubular 106.

Figure 2:
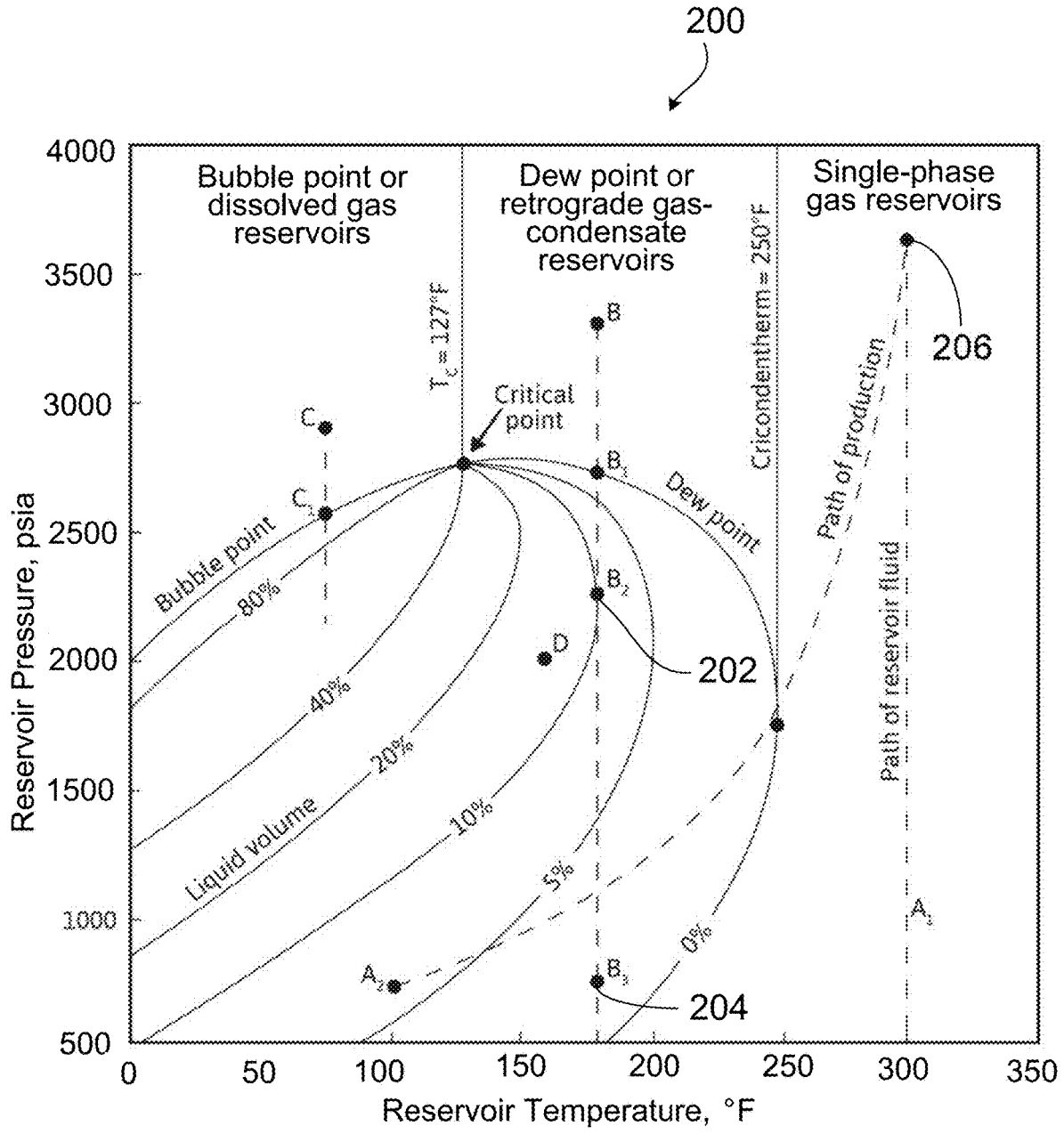
FIG. 2 is an example phase diagram.

FIG. 2 is an example phase diagram 200 illustrating the potential phases that can be found in a downhole environment, such as within wellbore 114. In operation, the well system 100 begins with the phase of produced fluid being point $B_2$ 202. Point $B_2$ 202 includes a temperature and pressure where sufficient condensate (liquid) is present to hinder gas flow through the wellbore 114. Once the vacuum chamber 104 is evacuated and fluidically exposed to the wellbore 114, the pressure brings the phase from point $B_2$ 202 to point $B_3$ 204. Point $B_3$ 204 includes a temperature and pressure where sufficient condensate (liquid) has been flashed off (liquid has been phase-changed to gas) to allow gas to more freely flow through the wellbore 114. In general, the aim is to bring the production point from $B_2$ 202 to $B_3$ 204 at constant temperature (which is the formation temperature). Such a pressure shift can decrease the amount of condensate liquid and therefore free the near production zone 112 from excessive liquid to increase gas production. In some implementations, the additional microwave emitter 162 can be used to heat the production fluid, moving the phase of the production fluid from point $B_2$ 202 to point $A_1$ 206. $A_1$ 206 is a point where the wellbore 114 produces single-phase gas. The pressure change from fluidically exposing the wellbore to the evacuated vacuum chamber 104 can be as high as 2500 pounds per square inch. While described as beginning at point $B_2$ 202, the phase changes described herein are applicable to any point where an amount of condensate is sufficient to reduce production flow.

Figure 3:
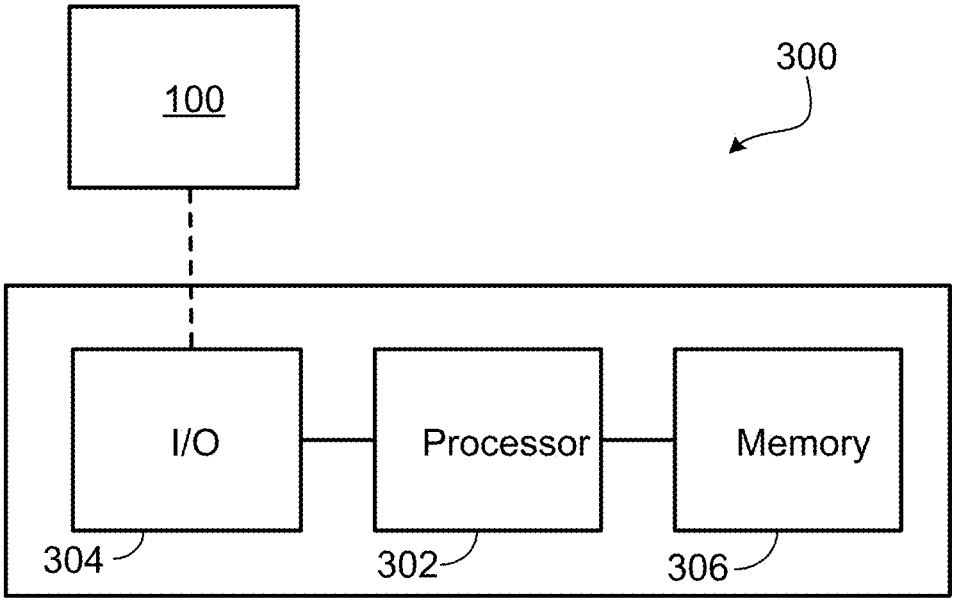
FIG. 3 is a block diagram of an example controller.

As shown in FIG. 3, the well system can include a controller 300 to, among other things, monitor pressures of the wellbore 114 and send signals to actuate the sleeve 158 or vacuum pump 102. As shown in FIG. 3, the controller 300 can include a processor 302 (implemented as one or more local or distributed processors) and non-transitory storage media (for example, memory 306—implemented as one or more local or distributed memories) containing instructions that cause the processor 302 to perform the methods described herein. The processor 302 is coupled to an input/output (I/O) interface 304 for sending and receiving communications with other equipment of the well system 100 (FIGS. 1A-1C) via communication links. In certain instances, the controller 300 can communicate status with and send actuation and control signals to one or more of the motor 160, the vacuum pump 102, the microwave emitter 162, and other components, such as topside valves, as well as various sensors (such as, pressure sensor 164, temperature sensors, and other types of sensors) at the well site. In certain instances, the controller 300 can communicate status and send actuation and control signals to one or more of the systems on at the topside facility 108, such as pumps, compressors, separators, and other equipment on the topside facility 108. The communications can be hard-wired, wireless, or a combination of wired and wireless. In some implementations, the controller 300 can be located remote from the well system 100, such as in a data van, at the topside facility 108, downhole within the wellbore 114, or even remote from the well system 100 (such as, at a central monitoring facility for monitoring and controlling multiple well sites). In some implementations, the controller 300 can be a distributed controller with different portions located about the well system 100 or off site. For example, in certain instances, a portion of the controller 300 can be distributed among individual well system 100 components, while another portion of the controller 300 can be located within a data van or control room.

The controller 300 can operate in monitoring, controlling, and using the well system 100 for reducing or eliminating a condensate cap within the wellbore 114. To monitor and control the well system 100, the controller 300 is used in conjunction with sensors to measure the pressure of fluid within the wellbore 114. Input and output signals, including the data from the sensors and actuators, controlled and monitored by the controller 300, can be logged continuously by the controller 300.

For example, an operator, via the controller 300, can orchestrate vacuum pump operations. For example, the memory 306 can include instructions for the processor to receive a signal indicative of a wellbore pressure, determine, based on the signal, a presence of a condensate bank or plug, evacuate a vacuum chamber, by a vacuum pump, in response to determining the presence of a condensate bank, and fluidically expose the evacuated vacuum chamber to a wellbore environment.

In some implementations, a human operator can operate the controller 300, and thus the resulting physical steps, at a safe distance from the high pressure lines, far enough that if there were a leak or failure, the operator would not be injured. The operation can be effectuated via a terminal or other control interface associated with the controller 300. In certain instances, the operator, via controller 300, actuates a fully automated sequence run by the controller 300 to perform the steps described herein (that is, the operator just presses start, or similar, and the controller 300 performs autonomously). Alternatively, the operator, via controller 300, commands one or more of the individual, later described steps. In either instance, the terminal can present menu items to the operator that present the operator's options in commanding the controller 300.

Figure 4:
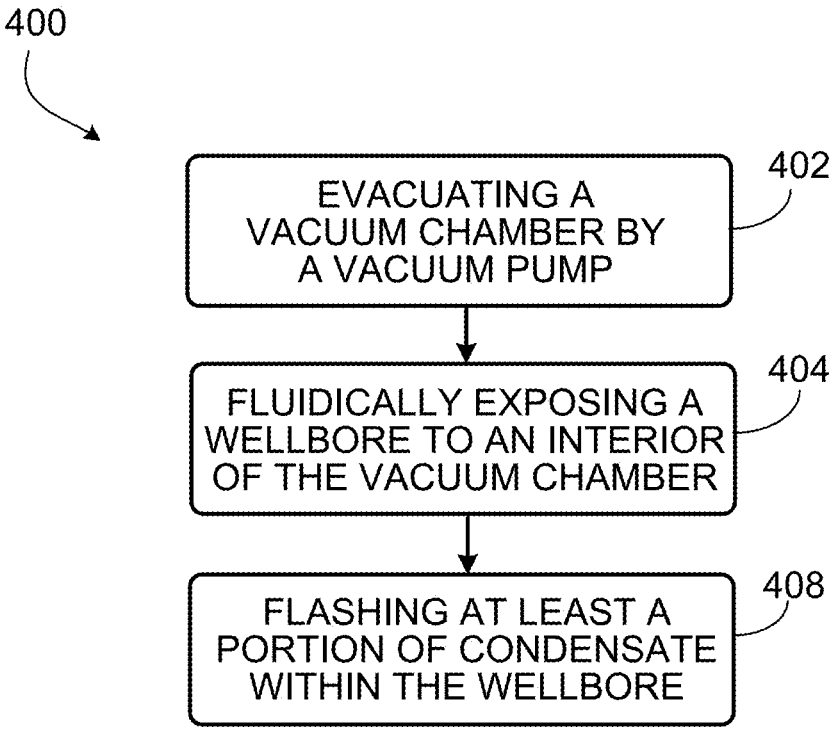
FIG. 4 is a flowchart of an example method that can be used with aspects of this disclosure.

FIG. 4 is a flowchart of an example method 400 that can be used with aspects of this disclosure. The vacuum chamber 104 is received by the wellbore 114. In some implementations, receiving the vacuum chamber 104 into the wellbore 114 includes receiving the vacuum chamber 104 such that the vacuum chamber 104 is at a depth substantially adjacent to the production zone 112 of the wellbore 114 (within typical field placement error).

At 402, the vacuum chamber 104 is evacuated by the vacuum pump 102. At 404, the wellbore is fluidically exposed to an interior of the vacuum chamber 104 after the vacuum chamber 104 has been evacuated. In some implantations, exposing the wellbore 114 to the interior of the vacuum chamber 104 reduces a pressure within the wellbore by 2500 pounds per square inch (PSI). In general, the pressure drop generated can vary between 500 PSI and 2500 PSI. For example, illustrated in FIG. 2, reducing the pressure from point $B_2$ 202 to point $B_3$ 204 results in a pressure decrease of about 1600 PSI. Fluidically exposing the wellbore 114 to an interior of the vacuum chamber 104 includes uncovering openings defined by an outer wall of the vacuum chamber 104, such as the orifice 152.

At 406, at least a portion of condensate within the wellbore 114 is flashed responsive to fluidically exposing a wellbore 114 to an interior of the evacuated vacuum chamber 104. In some implementations, microwaves can be emitted within the wellbore 114 by a microwave emitter 162 positioned within the wellbore. In such an implementation, at least a portion of condensate within the wellbore 114 is flashed responsive to the emitted microwaves.

After the condensate has flashed into free gas, the free gas can be flowed out of the wellbore in sufficient quantity to reduce the likelihood of a condensate cap reforming. In some implementations, multiple cycles of evacuation and exposure may be necessary to fully eliminate the condensation cap.

In some implementations, the vacuum chamber is removed from the wellbore after flashing the condensate. In such an implementation, the isolation packer 110 can be a removable isolation packer, and the tubular 106 can include coiled tubing, drill pipe, or some other tubular that is easily removed from the wellbore. In instances where a permanent installation is used, the tubular can be designed to accommodate the permanent operating conditions of the well. For example, improved metallurgy and greater wall thickness can be used in the tubular 106 in a permanent installation.

While this specification contains many specific implementation details, these should not be construed as limitations on the scope of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be previously described as acting in certain combinations and even initially claimed as such, one or more features from a claimed combination can in some cases be excised from the combination, and the claimed combination may be directed to a subcombination or variation of a sub combination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the previously described implementations should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method comprising:

evacuating a vacuum chamber by a vacuum pump, the vacuum chamber being positioned within a wellbore;

fluidically exposing a wellbore to an interior of the vacuum chamber after the vacuum chamber has been evacuated; and flashing at least a portion of condensate within the wellbore responsive to fluidically exposing a wellbore to an interior of the vacuum chamber.

2. The method of claim 1, further comprising receiving the vacuum chamber into the wellbore.

3. The method of claim 2, wherein receiving the vacuum chamber into the wellbore comprises receiving the vacuum chamber such that the vacuum chamber is at a depth roughly adjacent to a pay zone of a wellbore.

4. The method of claim 1, wherein exposing the wellbore to the interior of the vacuum chamber comprises reducing a pressure within the wellbore by 2500 pounds per square inch.

5. The method of claim 1, further comprising removing the vacuum chamber from the wellbore after flashing the condensate.

6. The method of claim 1, wherein fluidically exposing the wellbore to an interior of the vacuum chamber comprises uncovering openings defined by an outer wall of the vacuum chamber.

7. The method of claim 1, further comprising emitting microwaves within the wellbore by a microwave emitter positioned within the wellbore; and flashing at least a portion of condensate within the wellbore responsive to emitting the microwaves.

8. A method comprising:

evacuating a vacuum chamber by a vacuum pump, the vacuum chamber being positioned within a wellbore;

fluidically exposing a wellbore to an interior of the vacuum chamber after the vacuum chamber has been evacuated;

flashing at least a portion of condensate within the wellbore responsive to fluidically exposing a wellbore to an interior of the vacuum chamber; and flowing substantially free gas out of the wellbore.

9. A well intervention tool comprising:

a vacuum pump; and a vacuum chamber fluidically connected to the vacuum pump, the vacuum chamber comprising an outer surface defining a chamber fluidically coupled to the vacuum pump, the outer surface defining an actuable orifice that is actuable between and open state and a closed state, the orifice fluidically connecting the chamber and a downhole environment in the open state, the orifice fluidically isolating the chamber from the downhole environment in a closed state, wherein the actuable orifice comprises a sleeve defining a profile that mates with the outer surface of the vacuum chamber, the sleeve being rotatable in a circumferential direction along the surface of the vacuum chamber.

10. The well intervention tool of claim 9, wherein the vacuum pump is located within the downhole environment.

11. The well intervention tool of claim 9, further comprising a motor coupled to the sleeve, the motor arranged to change the sleeve between the open state and the closed state.

12. The well intervention tool of claim 9, wherein the vacuum pump comprises a positive displacement pump.

13. The well intervention tool of claim 9, wherein the orifice is a first orifice, the well intervention tool comprising a plurality of orifices, the orifices having a total flow area sufficient to allow fluid communication, each of the plurality of orifices having a flow area small enough to filter sand out of a fluid flow.

14. A well system comprising:

a vacuum pump;

a vacuum chamber fluidically connected to the vacuum pump, the vacuum chamber comprising an outer surface defining a chamber fluidically coupled to the vacuum pump, the outer surface defining an actuable orifice that is actuable between and open state and a closed state, the orifice fluidically connecting the chamber and a downhole environment in the open state, the orifice fluidically isolating the chamber from the downhole environment in a closed state; and a length of coiled tubing fluidically connecting the vacuum chamber to a topside facility, wherein the vacuum pump is located at the topside facility, the vacuum pump being fluidically connected to the vacuum chamber by the length of coiled tubing.

15. The well system of claim 14, further comprising a controller configure to:

receive a signal indicative of a wellbore pressure;

determine, based on the signal, a presence of a condensate bank;

evacuate a vacuum chamber, by a vacuum pump, in response to determining the presence of a condensate bank; and fluidically expose the evacuated vacuum chamber to a wellbore environment.

16. The well system of claim 14, wherein the actuable orifice comprises a sleeve defining a profile that mates with the outer surface of the vacuum chamber, the sleeve being rotatable in a circumferential direction along the surface of the vacuum chamber.

17. The well system of claim 16, further comprising a motor coupled to the sleeve, the motor arranged to change the sleeve between the open state and the closed state.

18. The well system of claim 14, wherein the vacuum chamber and length of coiled tubing are permanently installed within the downhole environment.

19. The well system of claim 14, further comprising sand separation facilities at the topside facility.

* * * * *